United States Patent [19]

Deck

[11] 4,060,024

[45] Nov. 29, 1977

[54] DAMPER ASSEMBLY

[75] Inventor: Arthur M. Deck, Houston, Tex.

[73] Assignee: Goodman Manufacturing Corporation, Houston, Tex.

[21] Appl. No.: 736,400

[22] Filed: Oct. 28, 1976

[51] Int. Cl.[2] ..... F24F 7/00

[52] U.S. Cl. ..... 98/40 VM; 85/8.8; 98/110; 98/121 A

[58] Field of Search ..... 98/40 VM, 110, 121 A; 85/8.8

[56] References Cited

U.S. PATENT DOCUMENTS

| | | | |
|---|---|---|---|
| 3,388,655 | 6/1968 | Dennis et al. | 98/40 VM |
| 3,938,430 | 2/1976 | Koppang | 98/121 A |

FOREIGN PATENT DOCUMENTS

| | | | |
|---|---|---|---|
| 1,407,950 | 6/1965 | France | 85/8.8 |

*Primary Examiner*—Ronald C. Capossela
*Attorney, Agent, or Firm*—Arnold, White & Durkee

[57] ABSTRACT

A damper assembly constructed of plastic for controlling airflow through a duct, wherein the blades are mounted for rotation between open and closed positions. The damper assembly includes a frame which is integrally formed with a louvered register and has a pair of spaced frame members with blade mounting portions defined therein in aligned cooperating pairs. The blade mounting portions are constructed to form a snap-in mounting for each of a series of generally rectangular blades having an axis of rotation, defined by journals at the ends of each blade, extending longitudinally and substantially centrally of the blade. The blades are operatively interconnected by intermeshing gears to be simultaneously rotated between the open and closed positions.

9 Claims, 6 Drawing Figures

DAMPER ASSEMBLY

BACKGROUND OF THE INVENTION

1. Field of the Invention

This invention relates to damper assemblies for installation within conventional air ducts to control airflow therethrough; and more particularly, the present invention relates to damper assemblies of the opposed blade type having a plurality of blades.

2. Prior Art

Damper assemblies for controlling airflow through a duct are well known and have achieved common use in most heating, airconditioning and ventilating systems installed in residences and commercial buildings. Typically, these damper assemblies comprise a frame structure adapted to be fitted to the end of a duct, defining a generally rectangular opening. The frame supports a plurality of damper blades which are pivotally mounted in the frame and move between open and closed positions, wherein a minimum of resistance to airflow is present when in the open position and airflow is blocked with substantially no leakage when in the closed position.

Blade type damper assemblies in the prior art have utilized blades fabricated from strips of metal, extruded metal, molded plastic, and a combination of metal and plastic. Prior art damper assemblies have taken on many configurations, but all have involved the assemblage in a frame of a set of controllable blades. Prior art damper assemblies having a plurality of controllable blades assembled in a set and supported in a frame have generally required a large number of individual parts which must be put together. The procedure of assembling numerous individual parts that comprise the blade support portion and the interconnecting control linkage portion is quite costly, thus making damper assemblies of that type quite expensive.

Damper assemblies of metal are the most prevalent in current use because of the relative low cost of metal dampers, by virtue of the simplicity and inexpensiveness of the machinery and equipment necessary to form the component parts. Metal dampers do, however, require a substantial amount of maintenance after installation, as they are subject to rusting and must be painted.

Plastic damper assemblies, while not being subject to the maintenance required for metal dampers, has the disadvantage of being more costly to fabricate. The injection molding machines and dies necessary to form the component parts are more expensive than the equipment for forming comparable metal parts, escalating the overall cost of the damper assembly. Thus, in order for plastic dampers to be cost competitive with metal dampers, the expensive procedure of assembling several component parts must be at least substantially eliminated.

Representative of the prior art damper assemblies is that disclosed in Scharres, U.S. Pat. No. 3,084,715. In the damper assembly disclosed there, the damper blades are formed by extruding material in a plastic state through a suitable die to form blades that are rectangular in shape and have a slot formed in the cross section of each end for receiving a stiffening member which comprises a stamped metal piece dimensioned to fit within the slot. The damper blades are pivotally supported in a rectangular frame. The mounting technique utilized to support the damper blades within the frame calls for the stiffening member to be formed with tangs projecting at each end. Fitted to each of the tangs is a shaft having an axial passage shaped to receive the tang, effecting a nonrotatable connection between the shaft and the damper blade. The shafts at the opposite ends of the damper blade are journaled in bearings supported on the side members of the frame structure, which frame members are apertured to receive the bearings. The bearings are a tubular sleeve of nylon or metal dimensioned to extend through aligned apertures in opposed frame members. A collar is utilized to retain the bearing in place in the assembly. In addition to the foregoing parts that must be assembled to mount the damper blades in the frame, it is also required that a linkage be attached to the assembly for coupling the damper blades together. A suitable linkage is disclosed in the patent for rotating the damper blades comprises a series of rigid links connecting the free ends of crank arms which are affixed to each damper blade. Alternatively, adjacent damper blades of the assembly could be coupled together by intermeshing gears mounted on the damper blade shafts.

Another damper assembly illustrative of prior art damper assemblies utilizing several individual parts to support the damper blades in a frame is that of McQuown, U.S. Pat. No. 3,176,715. The damper disclosed in McQuown is constucted of aluminum, with each blade being equipped at each end with a rotary bearing that is journaled in a circular opening in a side member of the frame. The rotary bearings are molded of plastic and include a hollow axial bearing stub that is rotatably journaled in the frame side member and a disc portion having external peripheral gear teeth. Each rotary bearing has inwardly projecting ribs provided on the disc portion, which ribs define a groove like mounting socket of the same size and configuration as the damper blade end to permit direct mounting of each blade between an aligned pair of rotary bearings. The disc portions of the rotary bearings are arranged with their gear teeth interlocking so that all damper blades rotate simultaneously from one position to another.

One attempt to provide a damper assembly having a plurality of damper blades, but which avoids the necessity of assembling several individual parts to form the complete mechanism is that of Eberhart, U.S. Pat. No. 3,301,164. Eberhart seeks to provide a low cost damper assembly by molding in a single operation an entire damper assembly having a plurality of movable vane members in a supporting framework with interconnecting control linkage. Thus, Eberhart's solution is to simultaneously form and mold as a single piece of plastic material the entire damper assembly. The movable vane are connected to the supporting framework by integrally molded flexible web portions to render the vanes movable on the frame. Also, a coupling linkage is provided by an integrally molded gang bar that is connected to a side edge of each vane by a flexible web portion, such that a reciprocating movement of the gang bar will cause a simultaneous pivotal movement of the interconnected vanes.

Another approach to obviating the costliness of damper assemblies having many individual parts that must be welded or otherwise joined together to form the damper assembly is that of Dry, U.S. Pat. No. 3,500,739. The damper assembly in Dry is a one-piece frame formed by injection molding in a die, with parts to be added to the frame to complete the assembly also being formed by injection molding in a die. More specifically, the damper assembly in Dry comprises a plastic L-shape frame having a series of U-shaped slots along the edge of the sides of the frame equally spaced from each other. A plurality of damper blades extend across the frame; the shutter blades having pin extensions for mating with the U-shaped slots on the frame. An extension projects from an end of each of the damper blades, with a lever engaging each of the extensions to provide simultaneous rotation of the blades between open and closed positions.

Accordingly, prior to the development of the present invention, there has been no plastic damper assembly for use in various types of airflow distribution systems, which is of simple construction employing only a few easy-to-assemble parts that may be put together without resort to an extensive assembly procedure, and which will be low in cost. Therefore, the art has sought an inexpensive, easy-to-assemble damper assembly absent the problems of previously proposed damper assemblies.

SUMMARY OF THE INVENTION

It is accordingly a feature of the instant invention to provide a damper assembly for use in air distribution systems to control airflow through a duct, having one or more damper blades supported on a frame for rotation between open and closed positions, and wherein the blades are mounted in a manner such that no costly assembly procedure is necessary. With a technique of mounting the damper blades without the necessity of an extensive assembly procedure and by constructing the damper assembly of plastic, a low cost damper assembly requiring little maintenance is provided.

In accordance with the present invention, each damper blade is provided with a journal at each end aligned to define an axis of rotation for the blade. Blade mounts are defined in aligned cooperating pairs in the side members of the frame. Each pair of blade mounts receives the journals on one of the blades to mount the same for rotation. The blade mounts defined in the frame members are snap-in type mounts having a bearing aperture in which the journal rotates and a tapering entry channel that intersects the bearing aperture. A restriction is formed at the intersection of the entry channel and the bearing aperture, such that in order for the journal to be urged into the bearing aperture the entry channel must spread apart by flexing of the portions of the blade mount that define the entry channel, with the channel assuming its original position after the journal has passed through the restriction and moved into the bearing aperture.

In a preferred embodiment of the invention, relief openings are formed adjacent the bearing aperture to facilitate flexing and spreading of the entry channel. Specifically, a relief opening is formed adjacent the bearing aperture on the opposite side of the entry channel. Also, additional relief openings may be provided along each side of the entry channel.

From the foregoing, it will be appreciated that if the blade mounts are constructed of a plastic material, such as high impact polystyrene, a very simple to manufacture and low cost damper assembly may be provided, which damper assembly does not require an extensive assembly procedure consisting of the assembling together of a multitude of individual parts. Further, a damper assembly constructed of plastic material would have the additional advantage of not having to be painted and would not be subject to rusting and corrosion.

BRIEF DESCRIPTION OF THE DRAWINGS

A more complete appreciation of the invention may be had by reference to the accompanying drawings, illustrating a preferred embodiment of the invention to be described in detail, in which like reference numerals designate identical or corresponding parts throughout the several views and wherein.

DETAILED DESCRIPTION OF A PREFERRED EMBODIMENT

For purposes of illustrating one embodiment of the present invention, there is shown in FIGS. 1–6 a damper assembly embodying the invention and generally indicated by the reference number 10. The damper assembly illustrated is suitable for use in heating, airconditioning and ventilating systems wherein it is necessary to control the flow of air through a duct or similar passage, and wherein the assembly is adapted for installation in a wall or ceiling.

Figure 1:
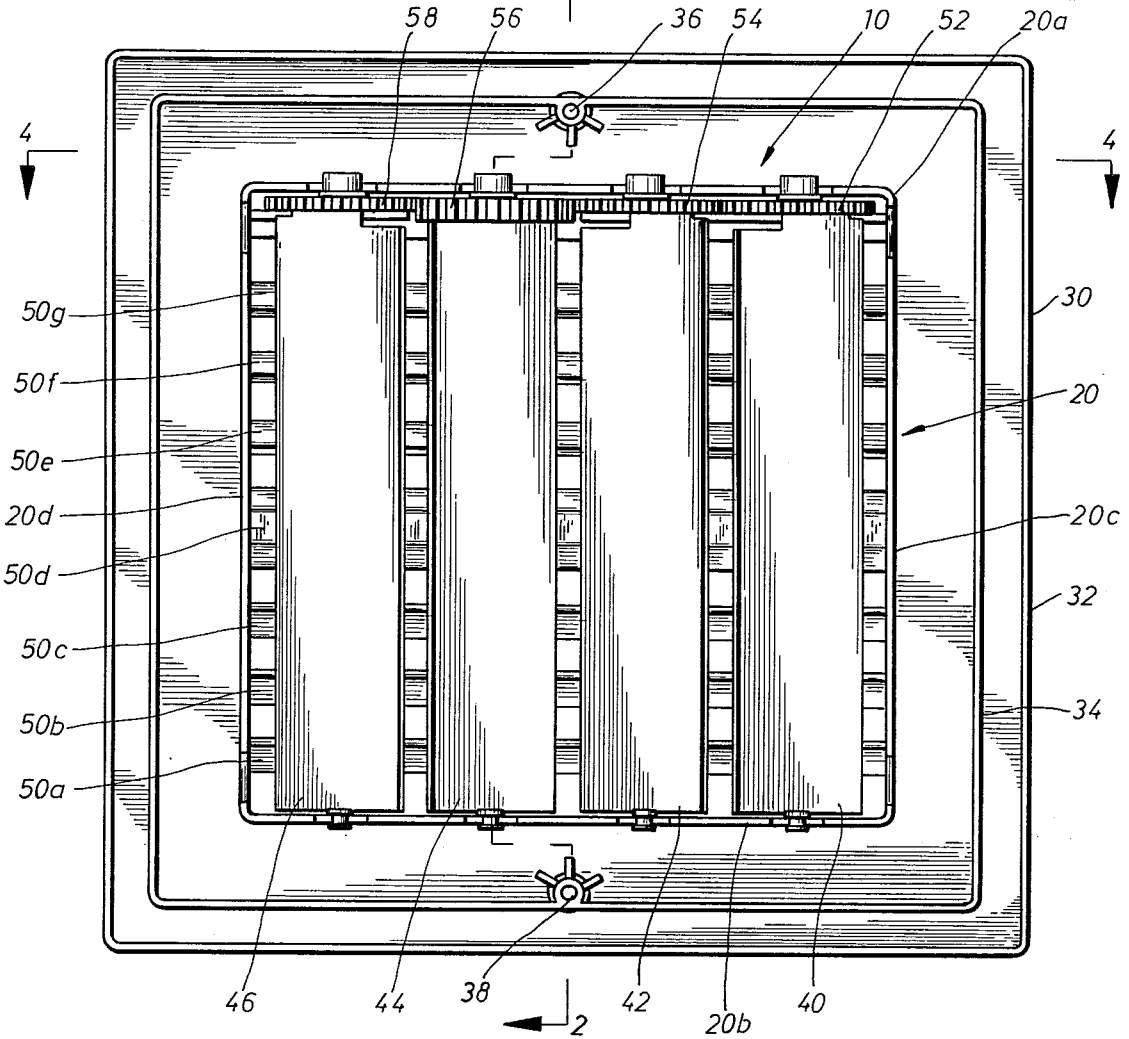
FIG. 1 is a plan view of a damper assembly in conjunction with a register in accordance with the present invention, illustrating the arrangement of the damper blades position on the register.

Referring now more specifically to FIG. 1 of the drawings, the damper assembly 10 as illustrated comprises a frame structure 20 integrally formed with a register 30. Frame 20, comprising side members **20*a*, 20*b* and cross members 20*c*, 20*d*, supports a plurality of damper blades 40, 42, 44 and 46 which pivot about spaced parallel axes between an open position wherein the blades present a minimum resistance to airflow and a closed position wherein the blades lie in a common plane with the adjacent blade tips engaging to form a substantially airtight seal across the frame opening. Movement of the blades from an open position to a closed position is effected by means operatively interconnecting the blades for simultaneous rotation on their respective axes. As shown in FIG. 1, the damper blades 40, 42, 44, and 46** are disposed in a position intermediate their open and closed positions.

Register 30 as illustrated is a substantially square structure having a series of louvers **50*a–g* for deflecting airflow coming through the damper assembly. Register 30 includes a pair of support ribs 32, 34 which extend in parallel spaced relation about the periphery of register 30. In order to hold the register in position against either a floor or ceiling structure, eyelets 36, 38 are provided and integrally formed with the innermost support rib 34**.

The means illustrated for simultaneously rotating blades 40, 42, 44, 46 when it is desired to either open or close the damper 10 is that of a series of intermeshing gears 52, 54, 56, 58. Because of the gear arrangement, the alternate blades 40 and 44 are rotated in a direction opposite the direction of rotation of blades 42 and 46. Accordingly, damper assembly 10 may be referred to as an opposed blade type damper.

Figure 2:
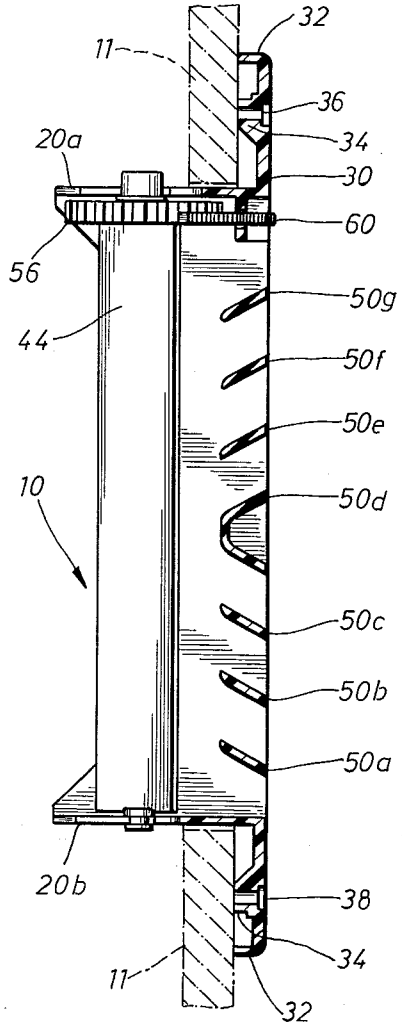
FIG. 2 is a cross sectional view of the damper assembly and register taken along line 2—2 in FIG. 1, and further illustrating the arrangement of the damper blades and associated components of the damper assembly.

Referring now to FIG. 2, a cross section of damper assembly 10 and register 30 is presented. As will be discerned from this view, frame 20 is integrally formed with register 30, such as by molding the entire structure in a single operation. Also from this view, an appreciation of the manner in which the damper assembly is mounted may be had. Specifically, in FIG. 2, the damper assembly and register are mounted in a wall or ceiling structure 11. Support ribs 32, 34 of register 30 are in abutment with the exterior surface of the wall or ceiling 11, with the frame 20 of damper assembly 10 extending through a rectangular opening in wall or ceiling 11. Screws (not shown) are entered into wall or ceiling 11 through eyelets 36, 38 in register 30 to hold the entire damper and register structure in position.

As shown, louvers 50*a–g*, which are also integrally formed with register 30 in a single molding operation, are tilted to deflect airflow coming through damper assembly 10 to distribute the flow of air within the room. If desired, louvers 50*a–g* could also be mounted on register 30 for adjustable movement to effect differing deflections or patterns for the airflow coming through damper assembly 10.

Figure 4:
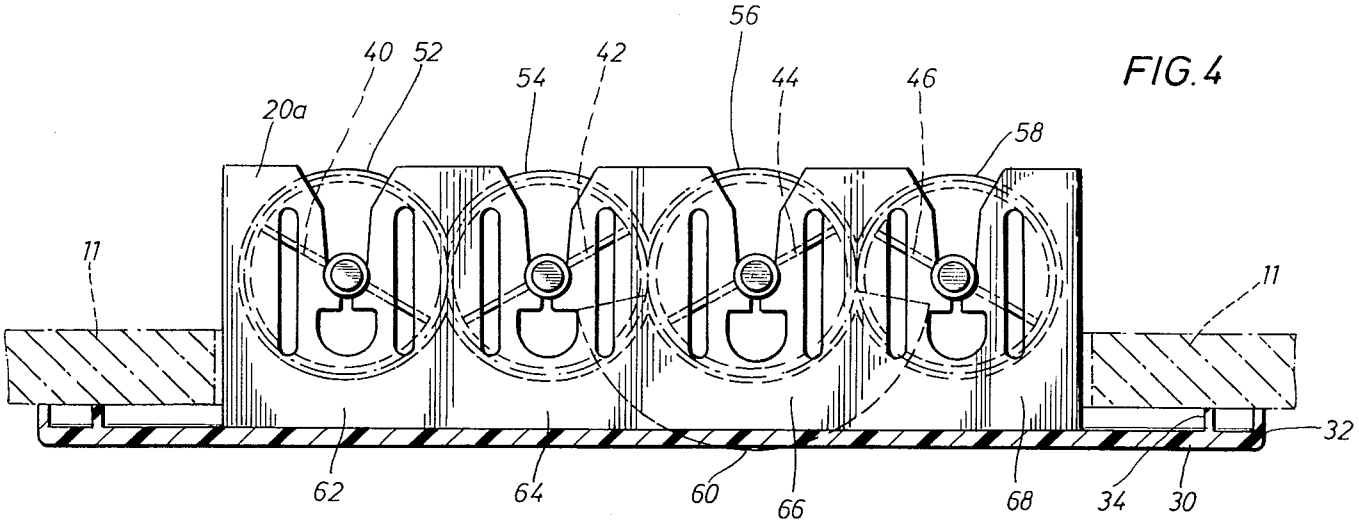
FIG. 4 is a cross sectional view of the damper assembly and register shown in FIGS. 1 and 2 taken along line 4—4 in FIG. 1, particularly showing details of one frame member and the blade mounts defined therein.
Figure 6:
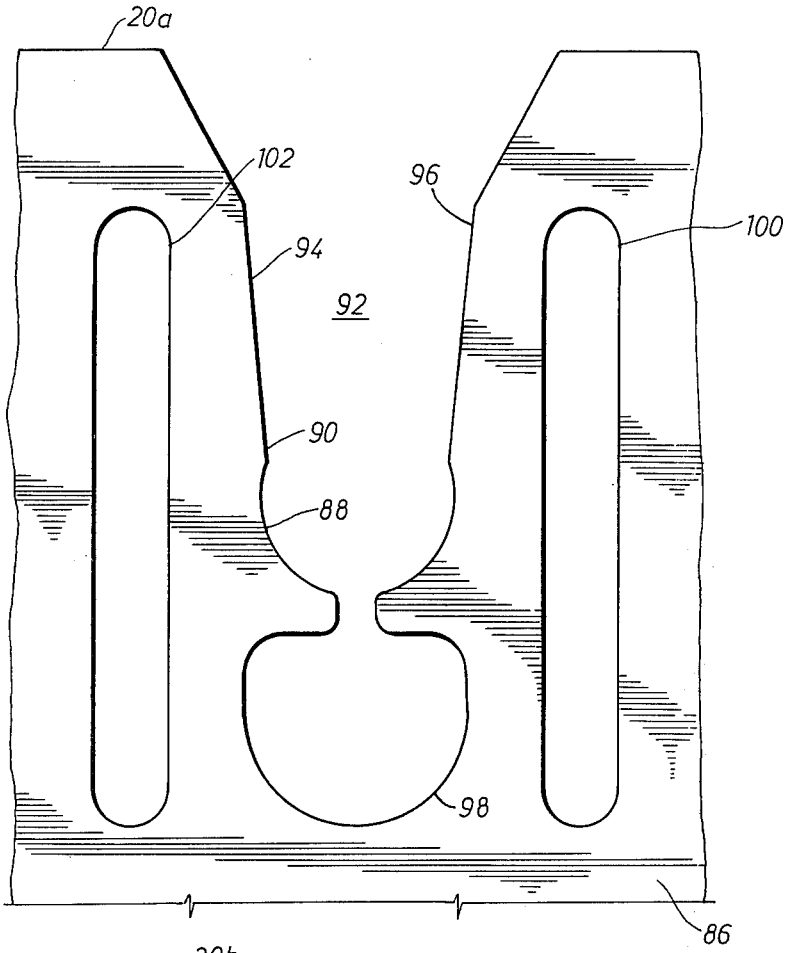
FIGS. 5 and 6 are enlarged views of representative blade mounts, providing details of the construction and configuration thereof.
Figure 5:
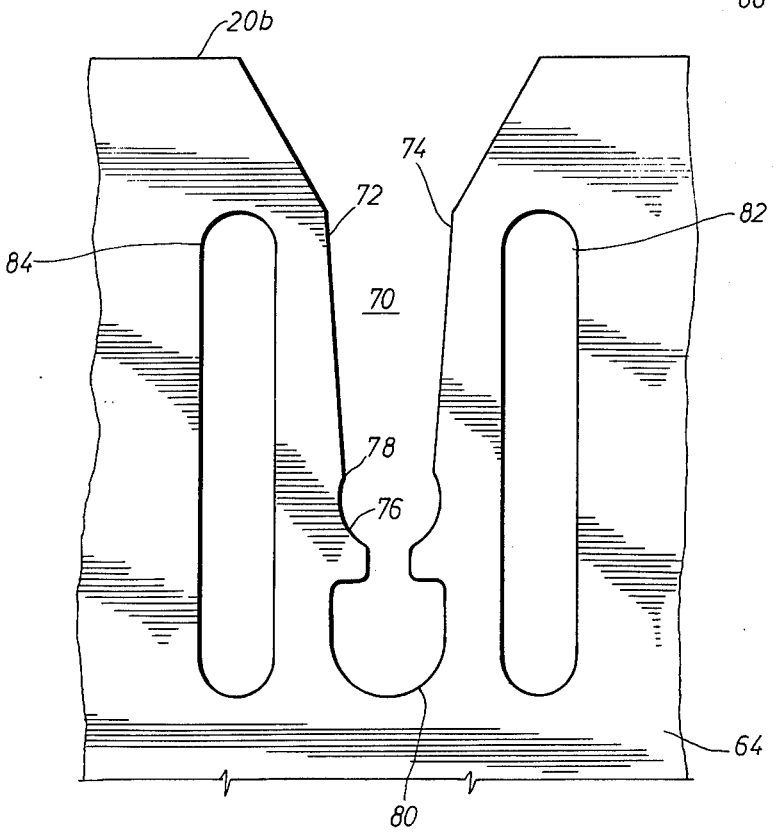

Blade 44 is mounted and supported for rotation in the pair of spaced frame members 20*a* and 20*b* of frame 20 in a manner to be described more fully in connection with FIGS. 4, 5 and 6. It should also be noted from FIG. 2, however, that a thumbwheel 60 is associated with, or integrally mounted upon, the lower portion of gear 56 and protrudes slightly outwardly from register 30. Upon rotating thumbwheel 60, gear 56 is rotated whereby this motion is imparted to intermeshing gears 52, 54, and 58 thus moving damper blades 40, 42, 44, and 46 into their opened or closed positions. The foregoing structure is also shown in FIGS. 3 and 4.

Figure 3:
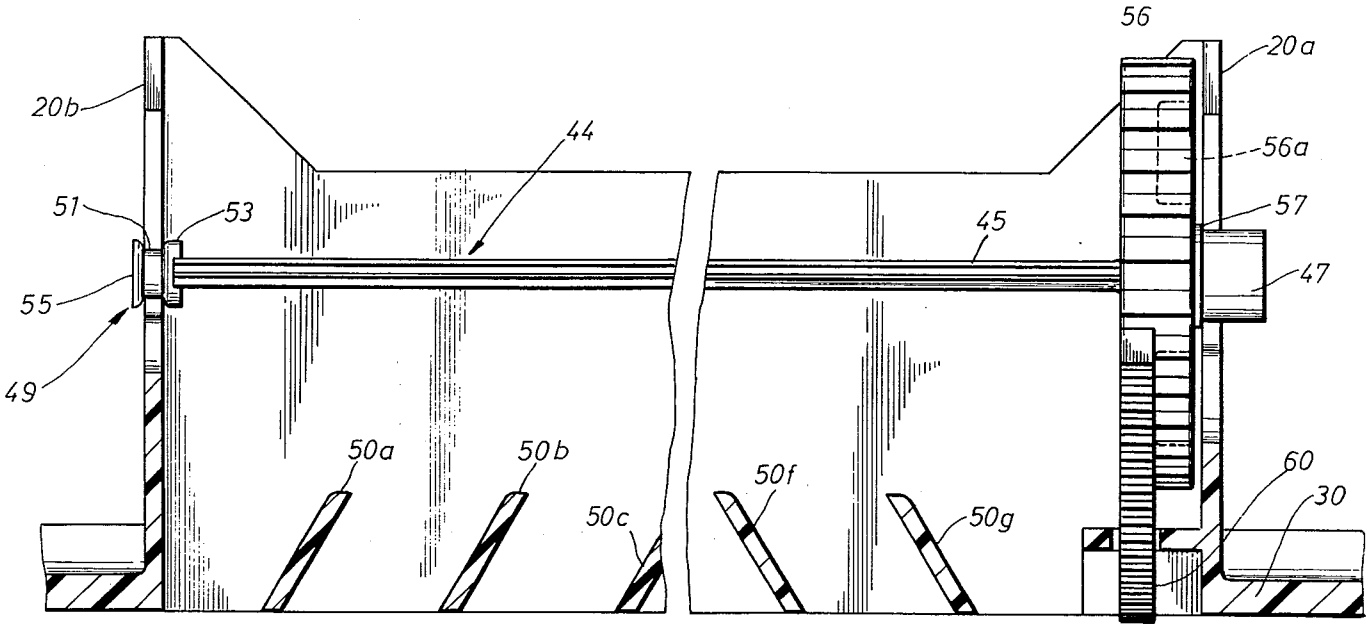
FIG. 3 is a more detailed illustration of the view in FIG. 2 particularly showing the details of construction of a representative one of the damper blades.

With reference to FIG. 3, blade 44, as do all of the blades, has an axle 45 extending longitudinally and substantially centrally thereof, defining an axis of rotation. Blade 44 is shown in its closed position wherein it lies in a plane which is substantially parallel with the plane formed by register 30. At one end of axle 45, gear 56 is secured thereto, with a journal portion 47 extending outwardly. At the end of axle 45 opposite gear 56, another journal portion 49 is mounted. Journals 47 and 49 are adapted to be mounted in frame 20 for rotation in a manner to be hereinafter described.

To prevent lateral shifting and cross-play of blade 44 within frame 20, journal portion 49 has a spool-like configuration. The intermediate portion 51 between inner and outer rims 53, 55 provides a surface that the journal turns on, with the rims preventing side to side movement between side frame members 20*a* and 20*b*. Journal 47 is of a uniform cylindrical configuration, although a rim 57 is provided where it attaches to gear 56.

With particular attention now to gear 56, it is observed to be a spur gear having a uniform width and teeth extending around its entire periphery. The gear is preferably molded integrally with axle 45 and journal 47; however, it may be separately molded apart from axle 45 and press fitted thereon. But for the inclusion of thubwheel 60 upon gear 56, gears 52, 54, and 58 are of like construction. Another feature of gear 56 is that a recessed cut-out 56*a* (shown in dotted outline) is formed in the side of gear 56 to facilitate rapid molding of the gear.

Turning now to FIG. 4, a side view of damper assembly 10 and register 30, which are mounted in a wall or ceiling 11, is presented which more particularly illustrates the structure of the spaced frame members of which frame member 20*a* is in view. Frame member 20*a*, as is frame member 20*b*, is an upright plate-like member of substantially uniform thickness having a separate blade mount formed therein for each of the damper blades. Specifically, frame member 20*a* includes blade mounts 62, 64, 66, 68. The blade mounts are arranged in side members 20*a* and 20*b* so as to be aligned in cooperating pairs, such that each pair receives and provides a respective blade with rotational movement. It will be appreciated that adjacent pairs of blade mounts are spaced such that adjacent blades will move into contact at the tips to form a substantially airtight closure between the blades. To this end the blade tips may be provided with recessed portions not shown extending the length of the blades whereby the recessed portions of one blade mates with the recessed portions of adjacent blade tips.

Referring next to FIGS. 5 and 6, an enlarged view of representative blade mounts for each of the spaced frame members 20*a* and 20*b* are illustrated. Specifically, FIG. 5 illustrates blade mount 64 formed in frame member 20*b*, which blade mount receives journal portion 49 of blade 44. Blade mount 64 comprises an entry channel 70 defined by opposed surfaces 72, 74. Channel 70 leads to a bearing aperture 76 in which journal portion 49 of blade 44 is to be disposed for rotation. Channel 70 narrows from a width greater than the diameter of bearing aperture 76 to a width less than the diameter of bearing aperture 76 at the point of intersection of channel 70 and aperture 76. Accordingly, a restriction 78 is formed at the entrance to bearing aperture 76. It is important to note that the restriction 78 formed at the entrance to bearing aperture 76 must be of such dimension that journal portion 49 will be securely held therein; however, restriction 78 should not be so narrow that journal portion 49 cannot be snapped into bearing aperture 76.

A relief opening 80 is formed adjacent bearing aperture 76 to permit opposed surfaces 72 and 74 to spread apart as journal portion 49 is advanced through channel 70 and snapped into bearing aperture 76. Additional relief openings are preferred, and accordingly, elongate relief openings 82 and 84 are formed in blade mount 64 on either side of bearing aperture 76 and extend substantially parallel to one another from a point proximate the entrance of channel 70 to a point proximate the the end of relief opening 80.

Referring now to FIG. 6, aligned, cooperating blade mount 86 defined in frame member 28 is illustrated. Blade mount 86 is identical in shape to blade mount 64; however, blade mount 86 is adapted to receive journal portion 47 of blade 44, which is of a larger diameter. The length of channel 92 defined by opposed surfaces 94 and 96 is substantially the same length as channel 70 of blade mount 64. Relief opening 98 in blade mount 86 is commensurately larger than relief opening 80 in blade mount 64, and elongate relief slots 100 and 102 in blade mount 86 are also slightly larger than are relief slots 82 and 84 in blade mount 64.

Accordingly, it will be appreciated that in order to install damper blade 44 in frame 20 it is only required that journal portions 47 and 49 at the ends of blade 44 be snapped into their respective bearing apertures 76, 88 and blade mounts 64, 86. More specifically, journals 47 and 49 are placed in the respective entry channel 70, 92 and moved therethrough toward their respective bearing apertures 76, 78. As each journal progresses through the entry channel, it comes into contact with the opposed surfaces that define the channel. Upon reaching the restriction formed by each channel at its intersection with the bearing aperture, the journals will be wedged into the channels. Additional force on the blade will cause the opposed surfaces of the channels to spread apart, allowing the journals to be snapped into their respective bearing aperture. Immediately after the journal portions have passed by the restriction, the opposed surfaces defining the entry channels spring back into position to prevent the journals from coming out. The ability of the opposed surfaces to spread apart is due to the relief openings formed adjacent the bearing apertures, which, as will be appreciated, creates a spring-like clip. The elasticity of the material used must also be such that it will deflect, but will restore itself to its initial position after the stress is removed.

Although damper assembly 10, and more particularly frame 20, could be constructed using a number of different types of materials, as long as it has proper elasticity, high impact polystyrene plastic is preferred as it is relatively inexpensive. Other materials which could be utilized include ABS plastic.

The foregoing description of the invention has been directed to a particular preferred embodiment in accordance with the requirements of the patent statutes and for purposes of explanation and illustration. It will be apparent, however, to those skilled in this art that many modifications and changes may be made without departing from the scope and spirit of the invention. For example, a damper assembly in accordance with the present invention may utilize a single damper blade rather than a plurality of adjacently disposed blades. Also, the damper blades may be coupled together by any of the numerous well-known linkage arrangements available in the damper assembly art, such as by a series of rigid links interconnecting the free ends of crank arms affixed to respective damper blades; and the damper blades may be coupled together to turn in the same direction or adjacent blades turn in opposite directions. Further, the side frame members may be formed separate from the register and mounted thereto by appropriate mounting means such as a snap-in connection or screw-in connection. Finally, it is to be appreciated that the present invention may be utilized in registers of rectangular configurations as well as those of a square configuration. These, and other modifications of the invention, will be apparent to those skilled in this art; and it is the applicant's intention in the following claims to cover all such equivalent modifications and variations as fall within the spirit and scope of the invention.

What is claimed is:

1. A damper assembly adapted to be installed in a wall or ceiling at the opening of an air duct to control air flow therethrough, which comprises:

a series of generally rectangular blades each having an axis of rotation extending longitudinally substantially centrally of the blade with a journal portion at each end;

means operatively interconnecting said blades for simultaneous rotation on said axes from an open position to a closed position; and a pair of spaced frame members having blade mounts defined therein in aligned cooperating pairs, each pair of blade mounts receiving the journal portions on one of said blades to mount the same for rotation;

each of said blade mounts having an entry channel defined by opposed surfaces leading to a bearing aperture, said channel narrowing from a width greater than the diameter of said bearing aperture to a width less than the diameter of said bearing aperture at the point of intersection of said channel and said aperture, and at least one relief opening formed adjacent said bearing aperture to permit said opposed surfaces to spread apart as said journal portion is advanced through the channel and snapped into said bearing apertures.

2. The damper assembly of claim 1 wherein:

said blade rotation means comprises a gear attached to each blade and rotatable in a plane that is inwardly of and alongside one of said frame members, said gears intermeshing.

3. The damper assembly of claim 1 wherein each of said blade mounts includes:

a first relief opening on the side of said bearing aperture opposite said entry channel; and second and third relief openings of an elongated configuration extending substantially parallel of one another on opposite sides of said bearing aperture.

4. The damper assembly of claim 1 further comprising:

a plastic register having louvers, said register being integrally molded to said frame members.

5. A damper assembly adapted to be installed in a wall or ceiling at the opening of an air duct to control air flow therethrough, which comprises:

a generally rectangular frame including parallel spaced apart side members and oppositely disposed end cross members, said side members and said cross members being plates disposed upright and integrally molded at the ends;

a series of blade mounts defined in said side members in aligned cooperating pairs, each of said blade mounts being a snap-in mounting having a bearing aperture, an entry channel inwardly tapering from the edge of the side member to said bearing aperture, and a relief opening adjacent the bearing aperture on the side thereof opposite the entry channel;

a plurality of damper blades supported at opposite ends in the blade mounts of the frame for limited rotational movement about axes extending longitudinally and substantially centrally of the blades defined by aligned pairs of journals affixed at the ends of the blades which are adapted to be received in the bearing aperture of a corresponding blade mount;

a series of intermeshing gears, each gear affixed to an end of one of said damper blades and rotatable in a plane inside of and alongside the corresponding side frame member; and a thumbwheel associated with one of said gears and protruding outwardly beyond said frame whereby said thumbwheel may impart rotational motion to said series of intermeshing gears.

6. The apparatus of claim 5 wherein each of said gears has a recessed cut-out therein to reduce the cross sectional area of the gear.

7. The apparatus of claim 5 wherein said frame and blades are constructed of high impact polystyrene plastic.

8. The apparatus of claim 5 wherein a louvered register is integrally formed with said frame.

9. The apparatus of claim 5 wherein the entry channel in each of said blade mounts is defined by opposed surfaces formed in said side frame and tapers from a width greater than the diameter of said bearing aperture to a width less than the diameter of said bearing aperture at the point of intersection of said channel with said bearing aperture, and wherein said relief opening permits said opposed surfaces to spread apart as the journals on the damper blades are advanced through the channels and snapped into their respective bearing aperture.

* * * * *